US007967036B2

(12) United States Patent
Ding et al.

(10) Patent No.: US 7,967,036 B2
(45) Date of Patent: Jun. 28, 2011

(54) RECIPICATING COMPRESSOR WITH INLET BOOSTER FOR CNG STATION AND REFUELING MOTOR VEHICLES

(75) Inventors: Denis Ding, Riverside, CA (US); Mitchell Pratt, Orange, CA (US)

(73) Assignee: Clean Energy Fuels Corp., Seal Beach, CA (US)

( * ) Notice: Subject to any disclaimer, the term of this patent is extended or adjusted under 35 U.S.C. 154(b) by 818 days.

(21) Appl. No.: 11/675,824

(22) Filed: Feb. 16, 2007

(65) Prior Publication Data

US 2008/0196384 A1 Aug. 21, 2008

(51) Int. Cl.
*B65B 3/04* (2006.01)

(52) U.S. Cl. ..... 141/44; 141/82; 141/85; 141/95

(58) Field of Classification Search ..... 141/4, 44, 141/69, 82, 85, 95
See application file for complete search history.

(56) References Cited

U.S. PATENT DOCUMENTS

| | | | | |
|---|---|---|---|---|
| 4,527,600 | A * | 7/1985 | Fisher et al. | 141/4 |
| 4,653,986 | A | 3/1987 | Ashton | |
| 5,238,030 | A * | 8/1993 | Miller et al. | 141/4 |
| 5,315,831 | A * | 5/1994 | Goode et al. | 141/4 |
| 5,351,726 | A * | 10/1994 | Diggins | 141/4 |
| 5,361,796 | A | 11/1994 | Mutter | |
| 5,363,655 | A * | 11/1994 | Kikkawa et al. | 62/613 |
| 5,370,159 | A * | 12/1994 | Price | 141/4 |
| 5,409,046 | A * | 4/1995 | Swenson et al. | 141/4 |
| 5,441,234 | A | 8/1995 | White et al. | |
| 5,538,051 | A | 7/1996 | Brown et al. | |
| 5,542,459 | A * | 8/1996 | Price et al. | 141/18 |
| 5,566,712 | A | 10/1996 | White et al. | |
| 5,613,532 | A | 3/1997 | Kaliszewski | |
| 5,615,561 | A | 4/1997 | Houshmand | |
| 5,630,328 | A * | 5/1997 | Hise et al. | 62/619 |
| 5,630,865 | A * | 5/1997 | Price | 95/39 |
| 5,694,985 | A | 12/1997 | Diggins | |
| 5,727,903 | A * | 3/1998 | Borray et al. | 405/128.15 |
| 5,839,886 | A | 11/1998 | Shaw | |
| 5,887,567 | A | 3/1999 | White et al. | |
| 6,176,046 | B1 | 1/2001 | Quine et al. | |
| 6,732,769 | B2 | 5/2004 | Del Campo | |
| 6,792,981 | B1 | 9/2004 | Manning et al. | |
| 7,069,730 | B2 * | 7/2006 | Emmer et al. | 141/82 |
| 7,222,647 | B2 * | 5/2007 | Bingham et al. | 141/82 |
| 7,284,575 | B2 * | 10/2007 | Gram et al. | 141/82 |
| 2005/0000802 | A1 | 1/2005 | Hobbs | |
| 2005/0016185 | A1 | 1/2005 | Emmer et al. | |
| 2005/0056661 | A1 | 3/2005 | Casamatta et al. | |

(Continued)

FOREIGN PATENT DOCUMENTS

| | | |
|---|---|---|
| CN | 1304010 | 7/2001 |

(Continued)

*Primary Examiner* — Gregory L Huson
*Assistant Examiner* — Nicolas A Arnett
(74) *Attorney, Agent, or Firm* — Sheppard, Mullin, Richter & Hampton LLP; David E. Heisey

(57) ABSTRACT

The present invention provides a natural gas compression system, comprising a gas inlet component for the entrance of natural gas into the system, a booster component for increasing the pressure of the natural gas, a drying component for drying the natural gas, a compressor component including a reciprocating compressor for further increasing the pressure of the natural gas, a valve control panel and storage component, and a dispensing component.

18 Claims, 1 Drawing Sheet

U.S. PATENT DOCUMENTS

| | | | |
|---|---|---|---|
| 2005/0284154 | A1 | 12/2005 | Peter et al. |
| 2006/0005895 | A1 | 1/2006 | Gram et al. |
| 2006/0068246 | A1 | 3/2006 | Matsuo et al. |
| 2006/0071016 | A1 | 4/2006 | Diggins |
| 2006/0118575 | A1 | 6/2006 | Boyd et al. |

FOREIGN PATENT DOCUMENTS

| | | |
|---|---|---|
| CN | 1713949 | 12/2005 |
| DE | 20 2005 020 648 | 6/2006 |
| WO | WO 01/51846 | 7/2001 |

* cited by examiner

RECIPICATING COMPRESSOR WITH INLET BOOSTER FOR CNG STATION AND REFUELING MOTOR VEHICLES

FIELD OF THE INVENTION

The present invention relates generally to compressors for compressed natural gas (CNG) stations for refueling motor vehicles, and more particularly to an inlet booster for a reciprocating compressor for a CNG station.

BACKGROUND OF THE INVENTION

Most conventional CNG stations are custom designed for specific site conditions, and must operate within predetermined inlet gas pressure and flow ranges. Such stations usually take a long time to build, and they are difficult to relocate from one location to another since they are designed to meet specific site conditions. According to other known CNG designs, the site conditions are modified to meet the equipment design specifications by utilizing an inlet gas regulator. Due to compressor design limitations, these stations often have to sacrifice gas pressure by going through the inlet regulator. After the gas is de-pressurized by the inlet regulator, it is then re-pressurized in the compressor. This design is very energy inefficient since the gas pressure is lowered before recompression in the compressor. Both custom-designed and site-modified systems are generally fixed speed and do not permit flow capacity control.

SUMMARY OF THE INVENTION

The present invention provides an inlet booster for a reciprocating compressor for a CNG station for refueling motor vehicles. Specifically, the inlet booster comprises an upfront booster to raise the inlet pressure going into a high pressure compressor, increase the maximum flow throughput, and provide flow adjustment controls. The inlet booster comprises a gas booster that is generally disposed in front of the high pressure compressor, in order to resolve the challenge of accepting a wide range of gas inlet pressures. The ability to control the gas flow capacity is achieved by providing flow control capability on the booster in combination with the high pressure compressor.

By way of example, the high pressure compressor may comprise a rotary, single-screw, positive-displacement compressor including a drive shaft, a main screw having six helical grooves, and two planar gaterotors. In such compressors, the drive shaft imparts rotary motion to the main screw, which drives the intermeshed gaterotors, whereby compression of the gas is achieved by engaging the two gaterotors with helical grooves in the main screw. Gas compression occurs when the individual fingers of each gaterotor sweep through the grooves of the main screw as the screw rotates. Other types of high pressure compressors may be employed without departing from the scope of the invention.

According to a preferred embodiment of the invention, a natural gas compression system comprises a gas inlet component for the entrance of natural gas into the system, a booster component for increasing the pressure of the natural gas, a drying component for drying the natural gas, a compressor component including a reciprocating compressor for further increasing the pressure of the natural gas, a valve control panel and storage component, and a dispensing component. The booster component may comprise an inlet booster for compressing the natural gas before entering the compressor component. In addition, the booster component may comprise an upfront booster to raise the inlet pressure going into the compressor component, thus increasing the system's maximum flow throughput and providing flow adjustment controls. The booster component may be configured to allow the system to accept a range of different site gas pressures from 0 psig to 200 psig. The capacity of the inlet booster may be adjusted to control an amount of gas compression capacity and power consumption.

In accordance with the preferred system of the invention, the booster component may comprise a single booster or multiple boosters disposed in parallel. According to the invention, the drying component may comprise a single tower or multiple towers of drying elements having the ability to regenerate when saturated, and the compressor component may comprise a single high pressure reciprocating compressor. Additionally, the valve control panel and storage component may comprise a series of control valves that direct the flow of gas from the compressor component to the dispensing component, or to local storage vessels. The booster component comprises a gas booster that is disposed in front of the high pressure compressor, and is also disposed in front of the drying component to allow for a more efficient design by reducing the actual volumetric flow of the drying component and raising the gas pressure that goes through the drying component. In some embodiments of the invention, the booster component, the drying component and the compressor component are housed inside an equipment enclosure such that the drying component is positioned between the inlet component and the compressor component.

According to a further embodiment of the invention, a natural gas compression system comprises a gas inlet component for the entrance of natural gas into the system, a booster component including an upfront inlet booster for increasing the pressure of the natural gas, a drying component for drying the natural gas comprising a single tower or multiple towers of drying elements having the ability to regenerate when saturated, a compressor component including a single high pressure reciprocating compressor for further increasing the pressure of the natural gas, a valve control panel and storage component, and a dispensing component. In operation, the upfront inlet booster raises the gas inlet pressure going into the compressor component, thus increasing the system's maximum flow throughput and providing flow adjustment control. The booster component is configured to allow the system to accept a range of different site gas pressures from 0 psig to 200 psig.

According to the invention, the capacity of the inlet booster may be adjusted to control an amount of gas compression capacity and power consumption. The booster component is preferably disposed in front of the high pressure compressor. In addition, the booster component may be disposed in front of the drying component to allow for a more efficient design by reducing the actual volumetric flow of the drying component and raising the gas pressure that goes through the drying component. According to some embodiments, the booster component, the drying component and the compressor component are housed inside an equipment enclosure such that the drying component is positioned between the inlet component and the compressor component.

Other features and advantages of the present invention should become apparent from the following description of the preferred embodiments, taken in conjunction with the accompanying drawings, which illustrate, by way of example, the principles of the invention.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein may illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

Figure 1:
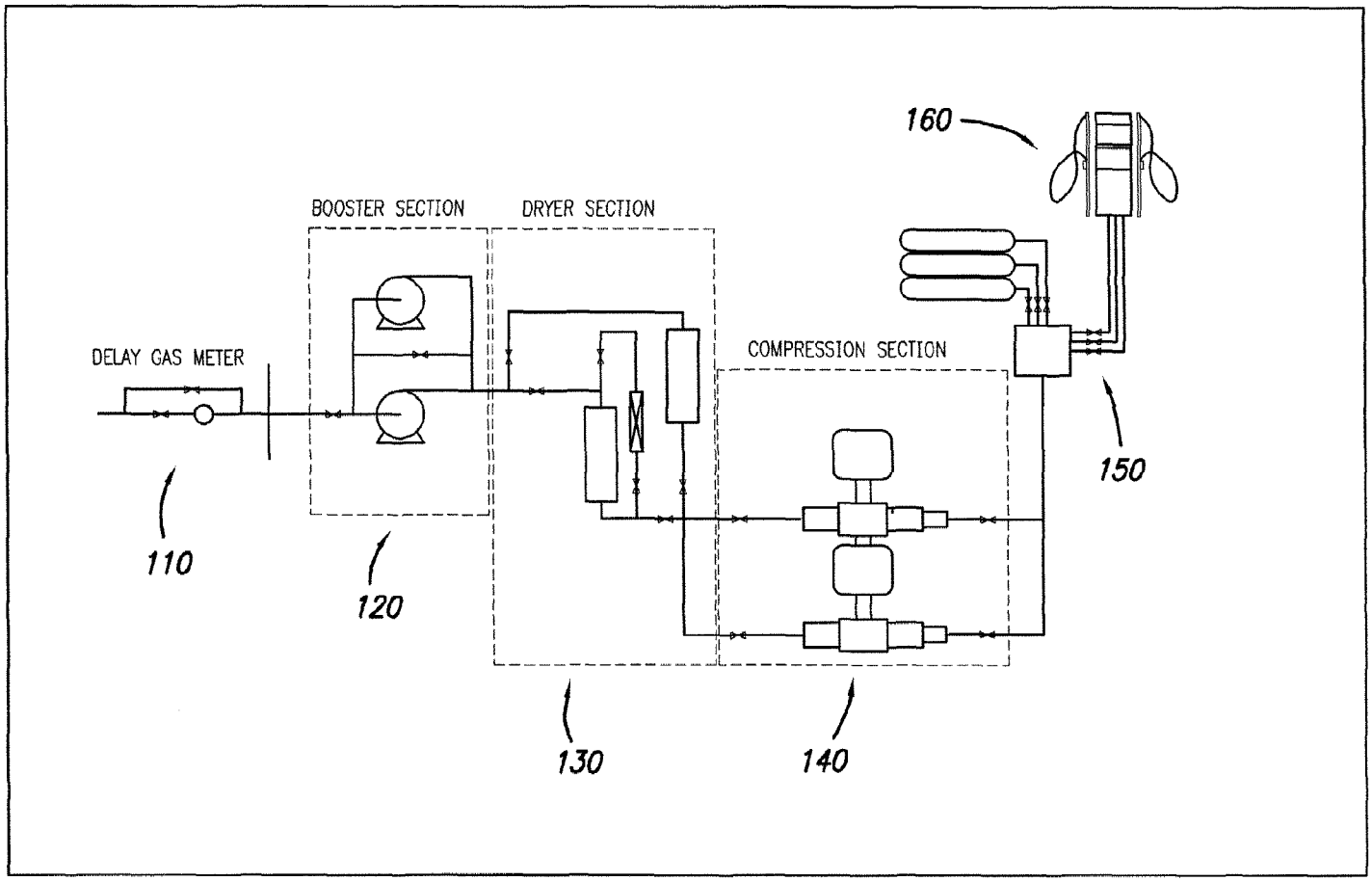

Embodiments of the present invention will now be described, by way of example only, with reference to the following drawings, in which:

FIG. 1 is a schematic diagram illustrating a preferred reciprocating compressor system having an inlet booster design, in accordance with the principles of the present invention.

DETAILED DESCRIPTION OF THE PREFERRED EMBODIMENTS

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

The present invention is directed to an inlet booster for a reciprocating compressor of a CNG station for refueling motor vehicles. In particular, the invention involves a CNG station that utilizes an upfront booster to raise the inlet pressure going into a high pressure compressor, thus increasing the station's maximum flow throughput and providing flow adjustment controls. In this manner, the inlet booster provides a method of accepting a wide range of inlet gas pressure conditions and providing adjustable flow capacity for a compressing natural gas refueling station. In other words, by adding an inlet booster of the invention, a CNG station gains the flexibility to accept a wide range of different site gas pressures (e.g., 0 psig to 200 psig). By adjusting the capacity of the inlet booster, the station can control the amount of gas compression capacity and power consumption (electric motor or engine).

The subject invention is to design a natural gas compression equipment package that has the ability to adapt to a wide range of inlet gas pressure from the local gas utility feed gas and provide adjustable gas flow capacity to meet different load requirement and optimize energy utilization. The inlet booster comprises a gas booster that is generally disposed in front of the high pressure compressor, in order to resolve the challenge of accepting a wide range of gas inlet pressures. The ability to control the gas flow capacity is achieved by providing flow control capability on the booster in combination with the high pressure compressor.

Referring to FIG. 1, in accordance with the principles of the invention, a preferred reciprocating compressor system 100 is illustrated having an inlet booster design comprising a gas inlet component 10, a booster component 120, a drying component 130, a compressor component 140, a valve control panel and storage component 150, and a dispensing component 160. By contrast, a conventional CNG station design does not feature a booster component. The booster component 120 may comprise a single booster, or alternatively may comprise multiple boosters disposed in parallel. The gas inlet component 110 may be provided at the site location by a local gas utility company. In addition, the drying component 130 may comprise a single tower or multiple towers of drying elements having the ability to automatically or manually regenerate itself when it becomes saturated.

In accordance with the principles of the invention, the compressor component 140 may comprise a single high pressure reciprocating compressor, or alternatively may comprise multiple reciprocating compressors disposed in parallel. In the illustrated embodiment, the compressor component comprises a rotary, single-screw, positive-displacement compressor such as manufactured commercially by Vilter Manufacturing Corporation (Cudahy, Wis.). In particular, the high pressure compressor comprises a drive shaft, a main screw having six helical grooves, and two planar gaterotors. In operation, the drive shaft imparts rotary motion to the main screw, which drives the intermeshed gaterotors, whereby compression of the gas is achieved by engaging the two gaterotors with helical grooves in the main screw. Gas compression occurs when the individual fingers of each gaterotor sweep through the grooves of the main screw as the screw rotates.

With further reference to FIG. 1, the valve control panel and storage component 150 may comprise a series of control valves that direct the flow of gas from the compressor component 140 to the dispensing component 160, or from the compressor component 140 to local storage vessels. According to the invention, the dispensing component 160 may comprise one or more dispensers such as light duty, medium duty or transit type dispensers and/or time-fill dispensing mechanisms.

As set forth above, the booster component 120 of the reciprocating compressor system 100 provides the ability to adapt to a wider range of gas inlet pressures and the ability to control the gas flow of the compressor. Additionally, the placement of the booster component 120 in front of the drying component 130 allows for a more efficient dryer design. Conventionally, a low gas pressure is provided by the local utility in combination with a large vessel to allow enough drying element to meet the compressor flow requirement. According to the invention, the actual volumetric flow of the dryer is reduced by putting a gas booster in front of the drying component 130 and raising the gas pressure that goes through the dryer. The actual volumetric flow of the dryer may be measured in terms of actual cubic feet per minute (ACFM).

According to the invention, the booster component 120, the drying component 130 and the compressor component 140 may be housed inside an equipment enclosure or other suitable housing. Specifically, the drying station 130 is positioned between the inlet booster 120 and the high pressure compressor 140. The dryer tower size and the associated piping may be reduced by providing higher pressure gas (from inlet booster 120) through the dryer desiccant bed, thus providing a cost savings. One end of the equipment enclosure may contain general purpose control components such as motor control center (MCC) control components and/or programmable logic controller (PLC) control components on one end, separated from the hazardous gas area by distance of separation method through un-pierced wall.

In a typical CNG station, a local gas company transports a natural gas supply to the site and builds a meter set assembly (MSA) on site to measure the amount of gas transferred to the station. These conventional CNG stations only utilize a high pressure compressor to compress the natural gas from the inlet pressure from the local gas utility to a final pressure of around 3600 psig to 4500 psig. By contrast, the reciprocating compressor system 100 of the invention employs a two-phase system comprising the inlet gas booster 120 to raise the inlet gas pressure from the local gas utility to an intermediate level (first phase) before passing the natural gas into the high pressure gas compressor 140 (second phase). In particular, the system 100 achieves a much higher maximum flow capacity by using the inlet booster 120 to raise the gas pressure to the most efficient running level of the high pressure compressor 140.

The natural gas from the local gas utility typically ranges from about 20 psig to about 60 psig. In accordance with the principles of the invention, the reciprocating compressor system 100 takes the natural gas from the local utility and passes it through the booster component 120. For example, the booster component 120 may comprise a variable capacity natural gas booster driven by an electric motor of up to approximately 250 break horsepower (bhp), wherein the booster raises the natural gas pressure up to 200 psig (first phase). At this point, the natural gas enters the dryer component 130, which may comprise a desiccant tower for stripping the moisture out of the natural gas stream. The dried natural gas then enters the compressor component 140, which may comprise a high pressure compressor driven by another electric motor of about 250 bhp to about 300 bhp, in order to raise the natural gas pressure to approximately 4500 psig (second phase). The high pressure natural gas is then stored in one or more storage vessels, or is directly dispensed into a natural gas vehicle (NGV).

According to the invention, the inlet booster capacity may be selectively varied from 0% to 100% based on the system load and operating hours. The high pressure compressor 140 may be designed to accept inlet pressure ranges from the local gas utility level (as low as 0 psig) to the post-booster level (around 200 psig). In addition, the total flow capacity of the reciprocating compressor system 100 can be adjusted to run from as low as 65 standard cubic feet per minute (scfm) to over 1000 scfm.

The reciprocating compressor system 100 described herein can achieve the same flow capacity with less equipment than conventional systems that require multiple high pressure compressors to achieve the same flow requirement, thereby providing a significant reduction in equipment capacity cost and site installation cost. In addition, the system 100 permits the high pressure compressor 140 to run at its maximum allowable settings by utilizing the inlet booster 120 to accommodate different local utility natural gas pressures. A further cost savings is realized by positioning the inlet booster 120 in front of the dryer station 130 such that higher pressure gas enters the dryer desiccant bed, and the dryer tower size and the associated piping may be reduced.

Thus, it is seen that an inlet booster for a reciprocating compressor for a CNG station for refueling motor vehicles is provided. One skilled in the art will appreciate that the present invention can be practiced by other than the various embodiments and preferred embodiments, which are presented in this description for purposes of illustration and not of limitation, and the present invention is limited only by the claims that follow. It is noted that equivalents for the particular embodiments discussed in this description may practice the invention as well.

While various embodiments of the present invention have been described above, it should be understood that they have been presented by way of example only, and not of limitation. Likewise, the various diagrams may depict an example architectural or other configuration for the invention, which is done to aid in understanding the features and functionality that may be included in the invention. The invention is not restricted to the illustrated example architectures or configurations, but the desired features may be implemented using a variety of alternative architectures and configurations. Indeed, it will be apparent to one of skill in the art how alternative functional, logical or physical partitioning and configurations may be implemented to implement the desired features of the present invention. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, may be combined in a single package or separately maintained and may further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives may be implemented without confinement to the illustrated examples. For example, block diagrams and their accompanying description should not be construed as mandating a particular architecture or configuration.

What is claimed is:

1. A CNG station for refueling motor vehicles, the CNG station comprising:

a gas inlet component for the entrance of natural gas into the system;

a booster component for increasing the pressure of the natural gas;

a drying component for drying the natural gas; and a compressor component including a reciprocating compressor for further increasing the pressure of the natural gas;

wherein the booster component can accept a range of different site gas pressures from approximately 0 psig to approximately 200 psig;

wherein a capacity of the booster component is adjustable to control an amount of gas compression capacity and power consumption.

2. The system of claim 1, wherein the booster component includes an inlet booster for compressing the natural gas before entering the compressor component.

3. The system of claim 1, wherein the booster component comprises an upfront booster to raise the inlet pressure going into the compressor component, thus increasing the system's maximum flow throughput and providing flow adjustment controls.

4. The system of claim 1, Wherein the capacity of the inlet booster is selectively varible from 0% to 100% based on system load and operating hours.

5. The system of claim 1, wherein the booster component comprises a single booster.

6. The system of claim 1, wherein the booster component comprises multiple boosters disposed in parallel.

7. The system of claim 1, wherein the drying component comprises a single tower or multiple towers of drying elements having the ability to regenerate when saturated.

8. The system of claim 1, wherein the compressor component comprises a single high pressure reciprocating compressor or multiple high pressure reciprocating compressors.

9. The system of claim 8, wherein the booster component comprises a gas booster that is disposed in front of the high pressure compressor.

10. The system of claim 1, further comprising a valve control panel and storage component comprising a series of control valves that direct the flow of gas from the compressor component to a dispensing component, or to local storage vessels.

11. The system o f claim 1, wherein the booster component is disposed in front of the drying component to allow for a more efficient design by reducing the actual volumetric flow of the drying component and raising the gas pressure that goes through the drying component.

12. The system of claim 1 wherein the booster component, the drying component and the compressor component are housed inside an equipment enclosure such that the drying component is positioned between the inlet component and the compressor component.

13. A CNG station for refueling motor vehicles, the CNG station comprising:

a gas inlet component for the entrance of natural gas into the system;

a booster component including an upfront inlet booster for increasing the pressure of the natural gas :

a drying component for drying the natural gas comprising a single tower or multiple towers of drying elements having the ability to regenerate when saturated; and a compressor component including a single or multiple high pressure reciprocating compressor(s) for further increasing the pressure of the natural gas;

wherein the booster component can accept a range of different site gas pressures from approximately 0 psig to approximately 200 psig.

14. The system of claim 13, wherein the upfront inlet booster raises the gas inlet pressure going into the compressor component, thus increasing the system's maximum flow throughput and providing flow adjustment control.

15. The system of claim 13, wherein the capacity of the inlet booster is selectively varied from 0% to 100% based on system load and operating hours.

16. The system of claim 13, wherein the booster component is disposed in front of the high pressure compressor.

17. The system of claim 13, wherein the booster component is disposed in front of the drying component to allow for a more efficient design by reducing the actual volumetric flow of the drying component and raising the gas pressure that goes through the drying component.

18. The system of claim 13, wherein the booster component, the drying component and the compressor component are housed inside an equipment enclosure such that the drying component is positioned between the inlet component and the compressor component.

* * * * *

UNITED STATES PATENT AND TRADEMARK OFFICE

CERTIFICATE OF CORRECTION

PATENT NO. : 7,967,036 B2
APPLICATION NO. : 11/675824
DATED : June 28, 2011
INVENTOR(S) : Denis Ding and Mitchell Pratt It is certified that error appears in the above-identified patent and that said Letters Patent is hereby corrected as shown below:

On the Title Page, Item (54) and Col. 1, Line 1, Title, please change "Recipicating" to "Reciprocating".

Signed and Sealed this
Sixteenth Day of August, 2011

David J. Kappos

David J. Kappos
*Director of the United States Patent and Trademark Office*